US011617939B2

(12) United States Patent
Webb

(10) Patent No.: US 11,617,939 B2
(45) Date of Patent: Apr. 4, 2023

(54) POOL CUE BRIDGE

(71) Applicant: Sean Webb, Blythe, GA (US)

(72) Inventor: Sean Webb, Blythe, GA (US)

( * ) Notice: Subject to any disclaimer, the term of this patent is extended or adjusted under 35 U.S.C. 154(b) by 0 days.

(21) Appl. No.: 17/222,079

(22) Filed: Apr. 5, 2021

(65) Prior Publication Data

US 2022/0258034 A1 Aug. 18, 2022

Related U.S. Application Data

(60) Provisional application No. 63/149,440, filed on Feb. 15, 2021.

(51) Int. Cl.
*A63D 15/10* (2006.01)

(52) U.S. Cl.
CPC ..... *A63D 15/105* (2013.01)

(58) Field of Classification Search
CPC ..... A63D 15/105; A63D 15/00
USPC ..... 473/42, 43, 2
See application file for complete search history.

(56) References Cited

U.S. PATENT DOCUMENTS 62,827 A * 3/1867 Dolan ..... A63D 15/105 473/42
199,105 A * 1/1878 Prentice ..... A63D 15/105 473/42
211,416 A * 1/1879 McIntire ..... A63D 15/105 473/42
2,817,525 A * 12/1957 Niemann ..... A63D 15/10 473/42
3,836,145 A * 9/1974 Frejd ..... A63D 15/105 473/42
4,907,799 A * 3/1990 Danner ..... A63D 15/105 473/42
4,953,860 A * 9/1990 Ames ..... A63D 15/105 473/42
5,181,718 A * 1/1993 Valentine ..... A63D 15/083 473/45
5,449,325 A * 9/1995 Dransfield ..... A63D 15/105 473/43
5,474,502 A * 12/1995 Brown ..... A63D 15/105 473/42

(Continued)

FOREIGN PATENT DOCUMENTS

GB 190925583 A * 6/1910 ..... A63D 15/105
GB 2151932 A * 7/1985 ..... A63D 15/105

(Continued)

*Primary Examiner* — Mitra Aryanpour
(74) *Attorney, Agent, or Firm* — Brennan, Manna & Diamond, LLC

(57) ABSTRACT

The present invention relates to a novel and extendable pool cue bridge device designed to provide greater stability while shooting a ball in a pool or billiards game. The cue bridge device has a transparent bridge head, a telescoping shaft with extendable segments or tubes configured to extend and retract the overall length of the shaft, a band for securing the device to a wrist or arm of a user and a removably attached adjustable stabilizer configured to move along the telescoping shaft for improved support and stability. The transparent bridge head is removably attached to a distal end of the telescoping shaft and the band is attached a proximal end of the shaft via a pivot ball. The transparent nature of the bridge head enables a player to view the end of the cue tip while making a shot.

16 Claims, 3 Drawing Sheets

(56) References Cited

U.S. PATENT DOCUMENTS

| | | | | |
|---|---|---|---|---|
| 6,419,588 | B1 * | 7/2002 | Watlack | A63D 15/105 473/42 |
| 6,929,555 | B2 * | 8/2005 | Morton | A63D 15/105 473/42 |
| 7,063,621 | B2 * | 6/2006 | Barry | A63D 15/105 473/42 |
| 7,722,472 | B2 * | 5/2010 | Cameron | A63B 69/0059 473/2 |
| D652,881 | S * | 1/2012 | Reddy | D21/753 |
| 9,539,492 | B1 * | 1/2017 | Eager | A63D 15/006 473/2 |
| 10,350,480 | B2 * | 7/2019 | Manou | A63D 15/105 473/43 |
| 2006/0009300 | A1 * | 1/2006 | Hernandez | A63D 15/105 473/42 |

FOREIGN PATENT DOCUMENTS

| | | | | |
|---|---|---|---|---|
| GB | 2162074 | A * | 1/1986 | A63D 15/006 |
| GB | 2323300 | A * | 9/1998 | A63D 15/105 |
| GB | 2437181 | A * | 10/2007 | A63D 15/105 |

* cited by examiner

POOL CUE BRIDGE

CROSS-REFERENCE TO RELATED APPLICATION

The present application claims priority to, and the benefit of, U.S. Provisional Application No. 63/149,440, that was filed on Feb. 15, 2021 and is incorporated herein by reference in its entirety.

FIELD OF THE INVENTION

The present invention relates generally to the field of recreational accessories. More specifically, the present invention relates to an extendable bridge for a pool cue that can be easily attached to a wrist or arm. The wrist bridge of the present invention comprises a transparent bridge attached to a distal end of a telescoping shaft. The shaft can be secured to an individual's arm during use (i.e. play) via the use of a wrist band or arm strap. Due to the transparent bridge design, the wrist bridge enables the shooter to view the end of his or her cue tip while the player addresses the cue ball. Additionally, the wrist bridge eliminates the need for the user to hold the bridge with one hand while shooting with the other hand, and offers a more comfortable way of playing pool or billiards. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, the game of pool, or billiards, has been in existence for well over a century and is played by individuals around the world. The game of pool is a strategic game played typically with two players, and is played on a pool or billiard table that includes six pockets spaced around a perimeter of rails circumscribing the playing surface of the pool table. The pockets represent 'cut-outs' or openings along the rails of the table. Object balls can be shot, i.e. contacted by the cue ball (or another object ball), and directed into a selected pocket around the table. Successful 'pocketing' of the object balls results in the object balls being deposited into the pockets. In order to play pool, participants require equipment such as a cue ball, a plurality of object balls, and a pool cue (i.e. cue stick). The pool cues can be selected as per the desires and comfort of the users. While using a pool cue, an individual will typically grip the butt end of the cue with the thumb and fingers of his or her dominant hand (i.e., right or left) and use the other non-dominant hand to loosely support the shaft of the pool cue, as the stroke is made. More specifically, the non-dominant hand can form a bridge for the shaft to provide a stable path of fore and aft movement of the pool cue during the stroke. However, individuals with physical limitations, handicaps or impairments may be limited to the use of only one hand to grasp the cue, thereby making the game difficult, if not impossible to play. Also, using the non-dominant hand to form the bridge for the pool cue may cause inconvenience or discomfort to the players. The standard height for the rails of a billiard table is at or about 33 inches. This standard height cannot be adjusted once the billiard table has been installed. A height of 33 inches presents difficulties for extending the non-dominant hand over the rails and onto the table surface when the player is small in stature or when the player is a child. Stated differently, smaller individuals oftentimes do not possess the necessary reach to effectively use their non-dominant hand as a bridge.

Equipment used for playing pool, such as pool cues and other devices, has been upgraded and modified over time to provide convenience to the users. For example, a bridge cue or bridge stick is popularly known to billiard players, and is used while playing the game of pool or billiards to help stabilize the player's cue stick. The bridge cue comprises a bridge head connected to a terminal or distal end of a fixed shaft of the bridge cue. The bridge head typically includes a plurality of notches that can be positioned near the cue ball in order to provide a guide or support to rest and aim the shaft of the pool cue. The bridge head provides stability and freedom of fore and aft movement to the pool cue shaft while shooting. The bridge head is typically comprised of a metal or other opaque material, and comes in a wide variety of shapes, colors, and designs, and can be selected as per the needs and requirements of the player.

Although the bridge cue eliminates the need to manually create the bridge using a player's hand, the bridge cue does require the player to manually pick up the bridge cue, place the bridge cue onto the table, align the bridge head, rest the shaft of the pool cue onto the bridge head, adjust the position of the bridge cue and bridge head, and then prepare to strike the cue ball with the pool cue. It is to be appreciated that the use of bridge cue, as described above, involves a player being in an upright orientation wherein the dominant hand grasps the butt of the pool cue and the non-dominant hand grasps the butt of the bridge cue. The upright orientation during use of the bridge cues, heretofore known, results in a less than ideal sight alignment (i.e. aim) of the cue ball and object ball. This compromised aim results in less accuracy when attempting to pocket object balls through use of the bridge cue. In addition, the step of manually setting up the bridge head for each shot may be both tiring and frustrating for the player, and also leads to wasted time during play. Additionally, the bridge heads that are currently available in the market are comprised of a metal or other opaque material that blocks the player's view of the cue tip and a portion of the cue ball at the point of contact between the cue tip and cue ball. This causes both inconvenience and inaccuracy when attempting to align the cue ball and object ball at the desired angle of impact in order to hit or 'shoot' the object ball into the pocket accordingly.

Therefore, there exists a long felt need in the art for an improved bridge cue that can be conveniently used by players for playing the game of pool or billiards. There is also a long felt need in the art for a bridge cue device that eliminates the need to manually create a bridge using the player's fingers and hand to provide a stable path while shooting the cue ball, and that is adjustable in overall length. Additionally, there is a long felt need in the art for a bridge cue device that can be easily used by people with physical limitations, height or reach limitations and/or other impairments, and that does not require the user to separately set up the bridge head using a non-dominant hand before or during the shot. Further, there is a long felt need in the art for a bridge cue device that does not block the player's view of the cue tip while preparing to strike or address the cue ball, and therefore improves the player's accuracy. Finally, there is a long felt need in the art for a bridge cue device that is relatively inexpensive to manufacture and that is both safe and easy to use.

The subject matter disclosed and claimed herein, in one embodiment thereof, comprises a novel pool cue bridge device configured to provide stability while shooting a ball during a pool or billiards game. The pool cue bridge device preferably comprises a transparent bridge head having a plurality of body spurs and cue supporting surfaces or areas, a telescoping shaft with extendable segments or tubes, a wrist band for securing the device around the wrist/arm of a user, and a removably attached and adjustable stabilizer configured to move along the telescoping shaft for additional support/stability. The telescoping shaft comprises two ends, a distal or tip end to which the transparent bridge head is removably attached and a proximal butt end to which the wrist band is attached via, for example, a pivot mechanism. The transparent configuration of the bridge head enables a player to view the cue tip and a portion of the shaft of the pool cue that extends beyond the bridge head distal to the player while shooting the cue ball at an object ball.

In this manner, the novel pool cue bridge of the present invention accomplishes all of the forgoing objectives, and provides a relatively easy, convenient and effective solution for supporting a pool cue shaft while playing the game of pool or billiards. The pool cue bridge of the present invention is also user friendly, inasmuch as it eliminates the need to manually create a bridge and provides a support for stable fore and aft movement of the pool cue while shooting pool. Additionally, the pool cue bridge can comprise transparent material for the bridge head, thereby making the view of the cue tip clearly visible, and assisting the player in addressing the cue ball. Further, the pool cue bridge positions the player in a more natural and desirable orientation while addressing the cue ball, and serves as an extension to the arm of the player. This natural orientation leads to more accurate play by the user.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a novel pool cue bridge device configured to provide better stability while shooting a ball in a pool or billiards game. The pool cue bridge device, in one embodiment thereof, comprises a transparent bridge head having a plurality of body spurs and cue supporting surfaces, a telescoping shaft with extendable segments or tubes, a wrist band for securing the shaft of the device to the wrist or arm of the player, and a removably attached and adjustable stabilizer that is configured to move along the telescoping shaft for improved support/stability. The telescoping shaft has two ends, a bottom or tip end to which the transparent bridge head is removably attached and a top or butt end to which the wrist band is attached via a pivot mechanism. The transparent nature of the bridge head enables the player to view the pool cue tip that extends beyond the bridge head (i.e., distal to the player) when the pool cue shaft is placed on one of the cue supporting areas of the bridge head.

In a further embodiment of the present invention, a telescoping pool cue bridge device is disclosed and comprises: a telescoping shaft having a plurality of telescoping segments configured to extend and retract the length of the telescoping shaft; a transparent bridge head connected to a distal or tip end of the telescoping shaft and having a plurality of body spurs and cue supporting surfaces for supporting a pool cue shaft; a hook and loop strap attached to a proximal or butt end of the telescoping shaft and configured for wearing around the arm of a player using the telescoping pool cue bridge device; and a removably attached adjustable stabilizer configured to move along the telescoping shaft for improved support/stability. The stabilizer fits between the player's fingers and can be configured to include a base portion for resting on the billiard table during use. The telescoping shaft may be extendable to approximately 5 feet in length, though longer lengths are also contemplated.

In yet a further embodiment of the present invention, an extendable bridge for a pool cue is disclosed and comprises an arm or wrist mounted extendable telescoping bridge for supporting a pool cue shaft during play. The bridge can be removably secured to the wrist or arm of a player via a hook and loop strap assembly. The wrist bridge can further include an adjustable stabilizer configured to be moved along the telescoping segments of the wrist bridge for improved support and stability during use of the bridge device.

In still a further embodiment, a bridge device to support a pool cue shaft in a stable manner is disclosed and comprises an adjustable stabilizer. The adjustable stabilizer comprises a base that can be placed on the pool or billiard table and is configured to be held between the fingers of a player. The adjustable stabilizer is configured to move along the extension sections, and may itself be telescoping. The bridge device further comprises an extension shaft extendable in length via telescoping segments, a releasable bridge head to support the pool cue shaft and a wrist band having a hook and loop closure to be worn or mounted around wrist or arm of the player.

The bridge device of the present invention enables a pool shooter or player to view the cue tip at the end of the pool cue shaft while addressing the cue ball due to its transparent design. The device described herein eliminates the need for players to hold the butt or proximal end of a bridge cue with a non-dominant hand while simultaneously holding the butt end of a pool cue with a dominant hand. The device further eliminates the need for forming a bridge with a player's fingers and hand to provide a stable fore and aft path for the pool cue shaft during a shot.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
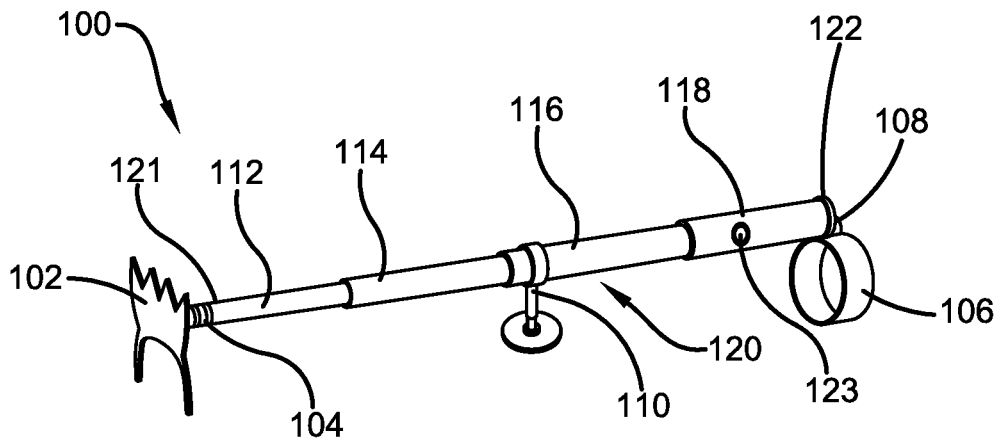
FIG. 1 illustrates a perspective view of one potential embodiment of the pool cue bridge device of the present invention in accordance with the disclosed architecture, wherein the device is meant to be used in a pool or billiards game.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a pool cue bridge device that can be conveniently used by players for playing a game of pool or billiards. There is also a long felt need in the art for a pool cue bridge device that eliminates the need to manually create a bridge using the player's fingers and hand to provide a stable path while shooting the cue ball, and that is adjustable in overall length. Additionally, there is a long felt need in the art for a pool cue bridge device that can be easily used by people with physical limitations, height or reach limitations and/or other impairments, and that does not require the user to separately set up the bridge head using a non-dominant hand before or during the shot. Further, there is a long felt need in the art for a pool cue bridge device that does not block the player's view of the cue tip while preparing to strike or address the cue ball, and therefore improves the player's accuracy. Finally, there is a long felt need in the art for a pool cue bridge device that is relatively inexpensive to manufacture and that is both safe and easy to use.

The present invention, in one exemplary embodiment, is a novel pool cue bridge device configured to provide stability while shooting a ball in a pool or billiards game. The pool cue bridge device comprises a transparent bridge head having a plurality of body spurs and cue supporting surfaces, a telescoping shaft with extendable segments or tubes, a wrist band for securing the device to a wrist and/or arm of a player, and a removably attached adjustable stabilizer configured to move along the length of the telescoping shaft for improved support and stability thereof. The telescoping shaft has two ends, namely a distal or tip end to which the transparent bridge head is removably attached, and a proximal or butt end to which the wrist band is attached. The wrist band can be pivotally connected to one of the telescoping shaft sections, but is preferably positioned at the proximal end of the shaft. The transparent nature of the bridge head enables a player to view the pool cue tip of the cue during his or her shot, and the bridge head can be placed on the billiard surface in at least two orientations, namely a portrait or a landscape orientation.

Referring initially to the drawings, FIG. 1 illustrates a perspective view of one potential embodiment of the pool cue bridge device 100 of the present invention in accordance with the disclosed architecture, wherein the device 100 is meant to be used in a pool or billiards game. The pool cue bridge device 100 is an improved pool cue bridge that can be easily worn on the wrist or arm of a player, and is used to help assist the player in moving a pool cue shaft fore and aft while aligning (i.e. addressing) the cue ball prior to striking the cue ball with the stick. The bridge device 100 preferably comprises a transparent bridge head 102 comprising a plurality of pool cue shaft supports or guides to support the pool cue shaft during a shot, wherein the bridge head 102 is removably connected 104 to a distal end of a telescoping bridge shaft assembly 120.

The telescoping bridge shaft assembly 120 is comprised of a distal end 121 (i.e., the end farthest from the player when the device 100 is in use), a proximal end 122 (i.e., the end closest to the player when the device 100 is in use), and a plurality of extendable tube segments 112, 114, 116, wherein each extendable tube segment is progressively tapered in shape and diameter so that a length of the shaft 120 can be shortened by collapsing one or more of the segments, or lengthened by fully extending one or more of the segments. More specifically, the diameter of the bottom extendable tube 112 is less than the diameter of the middle extendable tube 114 whose diameter is less than the diameter of the top extendable tube 116. Similarly, the length of the bottom extendable tube 112 is less than the length of middle extendable tube 114 whose length is less than the length of the top extendable tube 116. The telescoping mechanism of the telescoping tube assembly 120 enables the extendable tubes 112, 114, 116 to be easily extended and retracted. A butt tube or butt section 118 of the telescoping bridge shaft 120 is preferably fixed in length, and cannot be extended or contracted. In one embodiment, a push button 123 may be present on the surface of the butt tube 118 to actuate the tube segments 112, 114, 116 from a retracted orientation to an extended orientation and vice versa. In a fully compacted position, the device 100 may be approximately six to eight inches in length for easy storage and portability.

Figure 5:
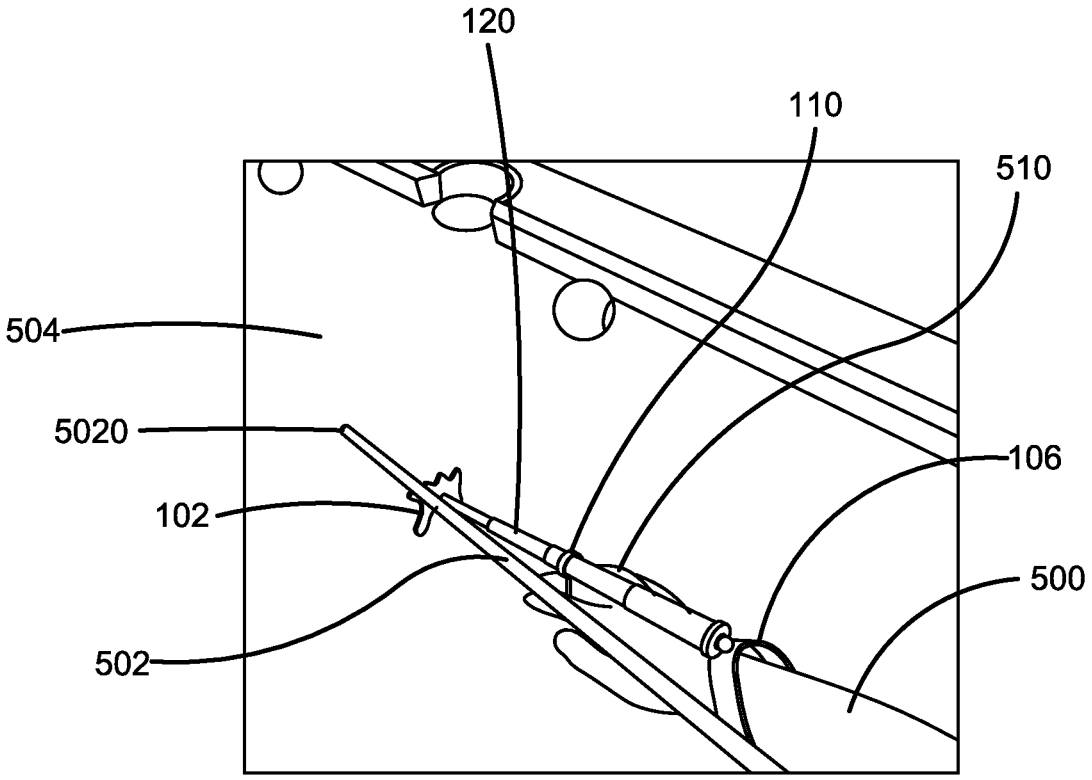
FIG. 5 illustrates a perspective view of one potential embodiment of the pool cue bridge device of the present invention in accordance with the disclosed architecture, wherein the device is being used by an individual to make a shot in a pool game.

The bridge device 100 also comprises a stabilizer stand 110 that is removably attached to, and configured to be selectively moved along the length of, one or more of the extendable tubes 112, 114, 116 or segment 118 while addressing the cue ball. The stabilizer stand 110 provides additional support and stability for the pool cue 502 while aiming the same at the cue ball. The stand 110 can easily fit between the fingers of a player, as best shown in FIG. 5 and more fully described below.

The bridge device 100 also comprises a strap 106 and a pivot assembly 108 for attaching the device 100 to the arm of an individual. The pivot assembly 108 is preferably attached to the proximal end 122 of the telescoping shaft 120, which is also the proximal end of the butt segment 118, and is used to connect the strap 106 to the shaft 120. The strap assembly 106 is preferably a flexible length of material or strap with a plurality of hook and loop fasteners thereon, or any other suitable attachment means, that can be wrapped around a player's wrist or arm to provide an anchor to the butt section 118 of the bridge device 100. While in use, the wrist bridge 100 comprises a natural extension to the player's non-dominant hand. When not needed, the tube assembly 120 can be retracted and pivoted about the loop strap 106 and then secured to the player's arm in a 'backward' orientation via, for example, another strap secured around the player's arm (not illustrated).

The telescoping mechanism of the bridge device 100 assists in controlling the length of extension of the shaft 120 to provide sufficient reach for any variety of shots. The bridge device 100 also enables a player to address the cue ball with greater stability, precision and control. The tube segments 112, 114, 116 of the shaft extend and retract in the same longitudinal direction about a common axis. The butt section 118 of the shaft may further comprise a grip portion of a size, shape and material comparable to a conventional pool cue grip area for easy and secure handling of the device 100.

Figure 2:
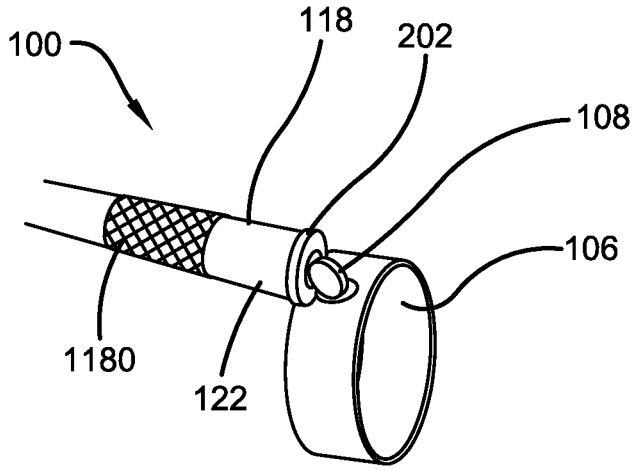
FIG. 2 illustrates a partial perspective view of one potential embodiment of the proximal end of the pool cue bridge device of the present invention in accordance with the disclosed architecture, wherein the strap and pivot ball are prominently displayed.

FIG. 2 illustrates a partial perspective view of one potential embodiment of the proximal end 122 of the pool cue bridge device 100 of the present invention in accordance with the disclosed architecture, wherein the strap assembly 106 and pivot ball 108 are prominently displayed. More specifically, the terminal end 202 of the bridge device 100 comprises the pivot ball 108 to attach the hook and loop strap assembly 106. The hook and loop strap assembly 106 can have any other type of fastener such as, but not limited to, a magnetic fastener, a snap, a button, etc., to customize the size and mounting of the hook and loop strap assembly 106 around the arm of a player. The butt section 118 can also include a grip 1180 for ease of handling of the bridge device 100. The bridge device 100 provides a selectively extendable bridge support for a pool cue shaft that can be attached to the wrist or arm of the player using the hook and loop strap assembly 106.

In one embodiment, the strap assembly 106 can be heat sealed. The strap assembly 106 is constructed to provide strength and durability, and is further constructed to fit any size wrist or arm. It is to be appreciated that the strap assembly 106 can be adjusted to any diameter in order to fit wrist sizes ranging from a small child to a large adult. The hook and loop fastener provides an adjustable fit so that the butt section 118 remains secured to a player's wrist during use. The strap assembly 106 can be made up of Lycra, nylon, or any other fabric or materials that exhibits both flexibility and elastic-like properties. The hook and loop closure of the strap 106 enables easy on and off application and adjustability options to efficiently place or tighten the strap 106 around the player's wrist or arm.

The tension of the strap 106 can be adjusted to the player's desired comfort level, and the strap 106 can have a custom logo, embroidery, trademark or print on its outer surface (not shown). As described, the strap assembly 106 can be made from sturdy components to withstand repeated use, and can also be made available in many different colors and sizes. The strap assembly 106 loops around the wrist or arm of a player and prevents the bridge device 100 from being dropped even if an individual loses their grip of the shaft 120 of the bridge device 100. The telescoping bridge device 100 also assists players having a weak grip, small hands, or a short reach, and may also be used by a player having a prosthetic hand.

Figure 3:
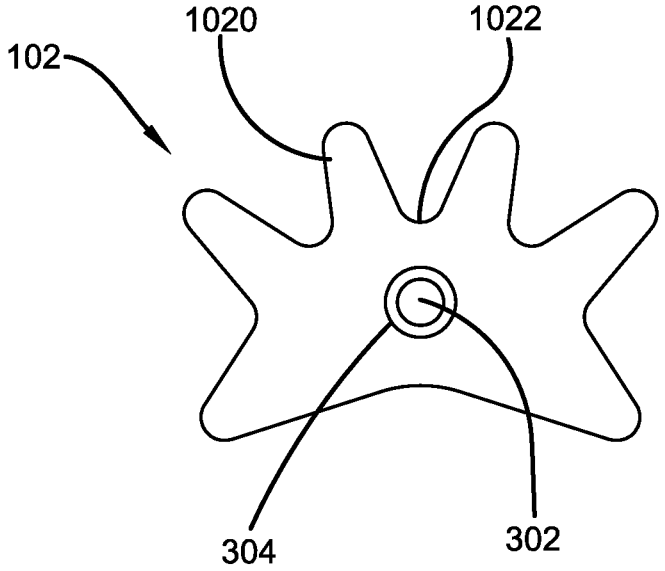
FIG. 3 illustrates a perspective end view of one potential embodiment of the distal end of the pool cue bridge device of the present invention in accordance with the disclosed architecture, wherein the bridge head is prominently displayed.

FIG. 3 illustrates a perspective end view of one potential embodiment of the distal end 121 of the pool cue bridge device 100 of the present invention in accordance with the disclosed architecture, wherein the bridge head 102 is prominently displayed. The bridge head 102 is configured to be removably attached at the tip end 104 of shaft section 112, and may be manufactured using a thermoplastic polymer such as Low Density Polyethylene (LDPE). LDPE is easy to process and mold into any desired shape, and can be bent or formed into any desired outline or geometric shape. Additionally, LDPE can be processed as transparent, due to its amorphous condition, to facilitate light transmittance and sight therethrough. The bridge head 102, in a transparent configuration, can also be made of a durable plastic. The transparent nature of the bridge head 102 enables the player to view the end of his or her cue tip while addressing and hitting the cue ball.

The bridge head 102 further comprises one or more body spurs 1020 and one or more cue shaft mounting surfaces 1022. The mounting surfaces 1022 provide selective mounting areas to mount the pool cue shaft 502 during a shot. In one illustrative example, the cue surfaces 1022 can be curvilinear in shape. The cue surfaces 1022 can also be in a V-shape, a C-shape, a concave semi-circular shape, or any other shape in order to provide support to the pool cue shaft resting thereon during a shot.

In one illustrative embodiment, the bridge head 102 has six body spurs 1020 and five pool cue shaft support areas or surfaces 1022. Three of the cue shaft support areas 1022 are usable when the bridge head is in the 'landscape' orientation as best shown in FIG. 3. Two of the cue shaft support areas are usable when the bridge head is in the 'portrait' orientation (not illustrated, but essentially rotated 90 degrees from the landscape orientation). At the center of the body of the bridge head 102, a threaded opening 304 is present with a central receiving portion 302. A terminal end of the tube portion 112 is received by the threaded opening 304 that is fastened to the bridge head 102 using a threaded fastener.

Figure 4:
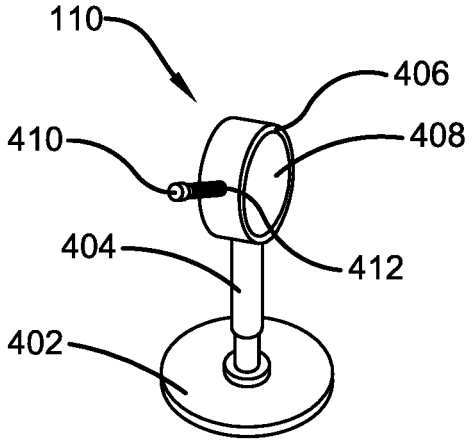
FIG. 4 illustrates a perspective view of one potential embodiment of the stabilizer stand of the pool cue bridge device of the present invention in accordance with the disclosed architecture, wherein the neck portion is telescoping.

FIG. 4 illustrates a perspective view of one potential embodiment of the stabilizer stand 110 of the pool cue bridge device 100 of the present invention in accordance with the disclosed architecture, wherein the neck portion 404 is telescoping. The adjustable stabilizer 110 can be repositioned along a length of one or more of the telescoping tube sections 112, 114, 116 and positioned to provide additional support to the shaft 120. The adjustable stabilizer 110 comprises a flat base 402, a telescoping neck 404 whose height can be adjusted by pulling up or pushing down on the same, a circular ring portion 406 that can be closed (as shown in FIG. 4) or alternatively can have a joint that can be opened to insert the bridge shaft 120 therethrough (not shown). The tube sections of the shaft 20 are received by an opening 408 in the adjustable stabilizer 110.

The inner surface of the circular portion 406 may have a rough surface that adheres to the outer surfaces of one or more of tube sections 112, 114, 116 or segment 118. In one preferred embodiment, a screw 410 is present that is inserted through a hole 412 in ring 406 and that extends into the opening 408. The screw 410 is kept loose (i.e., screwed out) when the tube sections 112, 114, 116 are initially being inserted into the opening 408. Once the stabilizer 110 is positioned in the desired location along the shaft 120, the screw 410 can be tightened (i.e., screwed in) into the hole 412 so that the stabilizer remains fixed at a desired location along the shaft 120.

Nonetheless, it should be appreciated that any other means of sizing the opening 408 as per the size of the telescopic tubes 112, 114, 116, 118 of the bridge device 100 can be used in the present invention in accordance with the disclosed architecture. The stabilizer stand 110 can be easily moved along the tubes 112, 114, 116, 118 of the bridge device 100 with the base 402 moving respectively on the billiard table surface to improve support and stability to the pool cue shaft supported thereby. The size of the adjustable stabilizer 110 is such that the neck 404 can be easily placed between any two fingers of a player with the base 402 under the palm and fingers of the player, as best shown in FIG. 5. Further, any type of threaded fastener, sealable tongue and groove fastener, snap fastener, clip type fastener, clasp type fastener, ratchet type fastener, a push-to-lock type connection method, a turn-to-lock type connection method, a slide-to-lock type connection method can also be used to secure the adjustable stabilizer 110 to the shaft 120 of the bridge device 100.

FIG. 5 illustrates a perspective view of one potential embodiment of the pool cue bridge device 100 of the present invention in accordance with the disclosed architecture, wherein the device 100 is being used by an individual to make a shot in a pool game. More specifically, a player wears the hook and loop strap assembly 106 around his or her non-dominant arm 500 and adjusts the strap 106 for a secure fit thereto. The stabilizer stand 110 is secured around the shaft 120 of the wrist bridge 100, and is placed between the fingers 510 of a player for a stable mount of the telescopic shaft assembly 120 on the billiard table surface 504. While addressing the cue ball, the player can place the pool cue shaft 502 on one of the cue shaft support surfaces 1022 of the bridge head 102. With the base of the bridge head 102 on the table surface 504, and with the adjustable stabilizer 110 between the player's fingers 510, and still further with the strap assembly 106 wrapped around the non-dominant arm 500 of the player, the player can freely address, aim, and shoot the cue ball with great balance and stability. The transparent bridge head 102 also enables the shooter to view the end of their pool cue 502, for example the cue tip 5020, while the pool cue shaft 502 approaches the cue ball and during impact of the cue tip 5020 hitting the cue ball.

The bridge head 102 can be positioned at a desired distance from a cue ball that the player intends to strike with the cue tip 5020 while the pool cue shaft 502 is supported by the bridge head 102. The pool cue shaft 502 can then be moved fore and aft with the dominant hand on the butt section of the pool cue. Once the cue ball is lined up, the player can strike the cue ball with the cue tip 5020 and direct the cue ball in the desired path towards an object ball. Contacting the object ball at the aligned angle will cause the object ball to be directed towards a pocket and deposited in same.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "wrist bridge device", "novel pool cue bridge device", "telescoping pool cue bridge device", "extendable bridge for a pool cue", and "bridge device" are interchangeable and refer to the pool cue bridge device 100 of the present invention.

Notwithstanding the forgoing, the pool cue bridge device 100 and its various components of the present invention can be of any suitable size and configuration as is known in the art without affecting the overall concept of the invention, provided that it accomplishes the above stated objectives. One of ordinary skill in the art will appreciate that the size, configuration and material of the pool cue bridge device 100 and its various components as shown in the FIGS. are for illustrative purposes only, and that many other sizes and shapes of the pool cue bridge device 100 are well within the scope of the present disclosure. Although the dimensions of the pool cue bridge device 100 and its various components are important design parameters for user convenience, the pool cue bridge device 100 and its various components may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A pool cue bridge configured to provide a support to a pool cue shaft, the pool cue bridge comprising:

a bridge head support having a mounting edge for selective placement of the pool cue shaft;

a telescoping section for adjusting a length of the pool cue bridge, wherein the telescoping section comprises at least two tube sections that are extendable and retractable via a push button; and an attachment mechanism for securement of said telescoping section to an arm of a user, the attachment mechanism comprising an adjustable loop strap attachable to a terminal end of the telescoping section opposite the bridge head support via a pivot ball.

2. The pool cue bridge of claim 1, wherein said telescoping section comprises at least three tube sections.

3. The pool cue bridge of claim 2, wherein said pool cue bridge further comprises a stabilizer with a base portion for resting on a pool table surface and a mounting portion for supporting said telescoping section.

4. The pool cue bridge of claim 3, wherein said stabilizer further comprises a height adjuster.

5. The pool cue bridge of claim 4, wherein said stabilizer is slidable along said telescoping section for selective positioning of said stabilizer.

6. The pool cue bridge of claim 1, wherein said bridge head is comprised of a transparent LDPE material.

7. A pool cue bridge configured to provide a support to a pool cue shaft, the pool cue bridge comprising:

a bridge head support having a mounting edge for selective placement of the pool cue shaft;

said mounting edge comprises at least three mounting areas;

a telescoping section for adjusting a length of the pool cue bridge, wherein the telescoping section comprises at least two tube sections; and a stabilizer with a base portion for resting on a pool table surface and a mounting portion for supporting said telescoping section, the mounting portion comprising a ring portion for engaging the telescoping sections and a locking element for temporarily securing the ring portion to the telescoping sections.

8. The pool cue bridge of claim 7, wherein said telescoping section comprises at least three tube sections.

9. The pool cue bridge of claim 7, wherein said pool cue bridge further comprises an attachment mechanism for securement of said telescoping section to an arm of a user.

10. The pool cue bridge of claim 7, wherein said stabilizer further comprises a height adjuster.

11. The pool cue bridge of claim 7, wherein said stabilizer is slidable along said telescoping section for selective positioning of said stabilizer.

12. The pool cue bridge of claim 7, wherein said bridge head is comprised of a transparent LDPE material.

13. The pool cue bridge of claim 9, wherein said attachment mechanism is selected from a group consisting of a snap, a button and a hook and loop fastener.

14. A method of using a pool cue bridge to address a cue ball with a pool cue shaft, said method comprising the steps of:

providing said pool cue bridge with an attachment mechanism, an adjustment mechanism and a mounting mechanism;

attaching a butt end of the pool cue bridge to an arm of a user via a loop strap that is magnetically adjustable in diameter;

adjusting a length of the pool cue bridge;

providing a stabilizer for the adjustment mechanism, and adjusting a height of the pool cue bridge by adjusting a length of the stabilizer;

selectively positioning the stabilizer along the length of the pool cue bridge by slidably moving said stabilizer along the length and temporarily locking the stabilizer at a position along the length;

mounting the pool cue shaft onto a bridge head of the pool cue bridge; and aligning a tip of the pool cue shaft with a cue ball.

15. The method of claim 14, further comprising the step of forming the adjustment mechanism from a telescoping sections; and adjusting the length of the pool cue bridge by extending the telescoping sections, wherein the telescoping section comprises at least two tube sections positioned in series.

16. The method of claim 14, wherein said bridge head is comprised of a transparent LDPE material.

* * * * *